United States Patent [19]

Kosaka et al.

[11] 4,243,716

[45] Jan. 6, 1981

[54] THERMAL SENSITIVE PAPER MINIMIZED IN RESIDUE DEPOSITION ON THERMAL HEAD

[75] Inventors: Takao Kosaka; Yukio Tahara, both of Takasago, Japan

[73] Assignee: Mitsubishi Paper Mills, Ltd., Tokyo, Japan

[21] Appl. No.: 925,883

[22] Filed: Jul. 18, 1978

[30] Foreign Application Priority Data

Jul. 29, 1977 [JP] Japan ..... 52-91011

[51] Int. Cl.[3] ..... B41M 5/18

[52] U.S. Cl. ..... 428/327; 282/27.5; 427/151; 428/524; 428/530; 428/913; 428/914

[58] Field of Search ..... 106/14.5, 21; 260/39 P; 282/27.5; 427/150, 151; 428/200, 307, 411, 537, 913, 914, 327, 530, 346–349, 542

[56] References Cited

U.S. PATENT DOCUMENTS

| | | | |
|---|---|---|---|
| 3,906,123 | 9/1975 | Vincent et al. | 427/150 X |
| 4,025,090 | 5/1977 | Petitpierre | 282/27.5 |

*Primary Examiner*—Bruce H. Hess

*Attorney, Agent, or Firm*—Cushman, Darby & Cushman

[57] ABSTRACT

A thermal sensitive paper having a heat sensitive layer containing a color-forming lactone compound and a phenol compound is amazingly lessened in possible deposition of its residue on the thermal head during the printing operation when finely divided urea-formaldehyde resin is incorporated in at least one of the heat sensitive layer, support and between said heat sensitive layer and support.

4 Claims, No Drawings

THERMAL SENSITIVE PAPER MINIMIZED IN RESIDUE DEPOSITION ON THERMAL HEAD

This invention relates to an improvement on thermal sensitive color-forming paper, and more particularly to a thermal sensitive paper minimized in possible deposition of its residue on the thermal head in use.

Thermal sensitive paper of the type in which the lactone dye and phenolic material are fused by heat of the thermal head to develop color is well known. In use of such thermal sensitive paper, however, the melt formed when color is developed tends to adhere to the thermal head to badly affect the printing quality. Such tendency is even promoted in use of thermal sensitive paper coated with wax for the purpose of preventing color formation by pressure or preventing chafing, fogging or scratching (such thermal sensitive paper is for instance disclosed in Japanese Patent Publication No. 14531/75). The problem becomes even more serious where printing is performed continously for a long time as in printing operation with a thermal facsimile or thermal printer.

Incorporation of an organic or inorganic filler such as clay, talc, starch, etc., is suggested for preventing adhesion of the melt to the thermal head, but te effect of such attempt is not always satisfactory.

As a result of further study, the present inventors found that various kinds of finely divided urea-formaldehyde resins commercially sold as paper filler, especially those having oil absorption rate of over 100 ml/100 g as measured according to JIS-K5101 method, have a surprising inhibitory effect against deposition of residue on the thermal head.

Such powdery resin may be incorporated either in the heat sensitive layer or the support or between the heat sensitive layer and support, and the effect in any case was amazing. The reasons for such marvelous effect of said resin powders are not yet definitely known, but it is considered that because the fine powders of urea-formaldehyde resins are extremely high in bulk, large in surface area and also high in oil absorptivity, they will instantaneously absorb or adsorb the melt of the lactone dye, phenolic material, etc., in the coating layer which would become the residue during the printing operation, thereby to minimize deposition of residue on the thermal head. Whatever the reasons may be, usefulness of this invention is immutable.

The colorless or light-colored color-farming lactone compounds used in this invention are of commonly used type, and the following may be cited as typical examples: Crystal Violet Lactone, Malachite Green lactone, 3,3-bis(paradimethylaminophenol)-4,5,6,7-tetrachlorophthalide, 3-ethylamino-6-chlorofluoran, 3-benzylamino-6-chlorofluoran, 3-cycylohexylamino-6-chlorofluoran, 3-morpholino-5,6-benzofluoran, 3-diethylamino-6-methyl-7-chlorofluoran, 3-diethylamino-7-chlorofluoran, 3-diethylamino-6,7-dimethylaminofluoran, 3-diethylamino-7,8-benzofluoran, 3-diethylamino-7-methoxyfluoran, 3-diethylamino-7-benzylaminofluoran, 3-diethylamino-7-anilinofluoran, 3-diethylamino-5,6-benzo-7-benzylaminofluoran, 3-diethylamino-7-methylaminofluoran, 3-diethylamino-6-methyl-7-anilinofluoran, 3-diethylamino-7-dibenzylamino-3',5',6'-tetrachlorofluoran, 3-ethyltolylamino-6-methyl-7-anilinofluoran, 3-pyrrolidino-6-methyl-7-anilinofluoran, 3-diethylamino-7-{N-methyl-N-(3'-trifluoromethylphenyl)amino}fluoran, and 3-diethylamino-7-(N-3'-trifluoromethylphenyl)aminofluoran.

The phenolic compounds used in this invention may be also of ordinary type but need be the ones which are liquefied or vaporized at a temperature of higher than 70° C. and reacted with said color-forming lactone compount to let it develop color. Preferred examples of such phenolic compounds are the ones having two or more hydroxyl groups in one molecule, such as 4,4'-isopropylidenediphenol, 4,4'-isopropylidene-bis(2-chlorophenol), 4,4'-isopropylidene-bis(2-tert-butylphenol), 4,4'-sec-butylidenediphenol, 4,4'-cyclohexylidenediphenol, bisphenolsulfone, 4,4'-thiobis-(4-tertbutyl-3-methylphenol), 2,2'-bis-(4-hydroxyphenol)-n-heptane, novolak phenol resins, and halogenated novolak phenol resins. These materials were cited merely by way of example and not in a restrictive sense.

The wax used, if need be, in this invention for the purpose of preventing color formation by pressure, scratches, etc., may be animal wax such as shellac wax, vegetable wax such as carnauba wax, petroleum wax such as paraffin, synthetic wax such as polyethylene wax, and other higher fatty acid amides, as mentioned in Japanese Patent Publication No. 14531/75. These waxes may be used either singly or in combination and in the form of fine powder or emulsion.

The fine powder of urea-formaldehyde resin used in this invention is of commonly used as paper filler and preferably has an average particle size within the range of 2$\mu$ to 8$\mu$, and is preferably of the type which, when mixed in the coating solution, can be well dispersed in such solution with the aid of a dispersant. Use of coarse particles results in a rough coated surface of the heat sensitive paper and poor color development to reduce the commerical value of the product. In case of incorporating said resin powder in the support or overcoating it by surface sizing, such can be accomplished in the same way as application of an inorganic pigment in paper making. When coating is performed with a coater head such as air knife, rubber doctor, steel blade, roll, Meyer bar, etc., it is preferred to disperse the resin in the coating solution together with a latex such as SBR latex, NBR latex, etc., or other aqueous high molecular adhesive such as starch, polyvinyl alcohol, carboxymethyl cellulose, methylvinyl ether and maleic acid copolymer, styrene and maleic acid copolymer, hydroxyethyl cellulose, casein, gelatin, gum arabic, etc.

Said resin is preferably used in an amount of 10 to 200 wt% based on the weight of the heat fusible material such as lactone dye, phenolic material, wax, etc., in case the composition is incorporated in the coating layer or overcoated on the support. Resin loading of less than 10% can not provide a satisfactory effect while more than 200% loading may result in a too poor color development of the heat sensitive paper or impaired properties of the support.

In the case of sandwich application, it is necessary that the resin is present in an amount of more than a certain level on the surface contacting with the heat sensitive layer, so that in such case the resin loading should be somewhat greater than in the case of coating layer incorporation or surface overcoating.

The oil absorption of fine urea-formaldehyde powder used in this invention is preferably higher than 100 ml/100 g as measured according to JIS K-5101 method. Determination of "oil absorption according to JIS K-5101 method" is as follows: 1 to 5 gr of specimen is spread on a glass plate (measuring approximately 250×250×5 mm) and boiled linseed oil is dropped portionwise from a buret to the center of the specimen, the entire material being kneaded sufficiently with a spatula upon each dropping. Such dropping and kneading are repeated until the entire material becomes a solid putty-like mass that can be helically dragged up with a steel spatula. At this point, the oil absorption G is determined from the amount of boiled linseed oil used according to the following formula:

$$G=H/S\times 100$$

where H=amount of linseed oil used (ml)

S=specimen weight (g)

In case the putty-like mass can not be formed into a volute but is rapidly softened upon addition of a drop of boiled linseed oil (as experienced when using certain kinds of pigment), the moment before the material sticks to the glass plate is considered as end point, and the above calculation is made at this point.

Any ordinary type of adhesives may be used for the heat sensitive layer of this invention, but it is preferred to use the water-soluble high molecular adhesives rather than the heat fusible ones, and preferred examples of such adhesives include starch, polyvinyl alcohol, carboxymethyl cellulose, methyl vinyl ether-maleic acid copolymers, hydroxyethyl cellulose, casein, gelatin and gum arabic.

The heat sensitive coating layer may be also added with a brightener, filler and/or the like such as talc, clay, starch grains, etc.

It is also possible to add other additives serviceable as sensitivity improver, such as disclosed in Japanese Patent Publication No. 4160/68, Japanese Patent Kokai (Laid-Open) No. 19231/73 and Japanese Patent Kokai (Laid-Open) No. 58842/74, for minimizing power consumption and increasing printing speed in a thermal facsimile, thermal printer or such.

The heat sensitive layer used in this invention may be formed according to a normal method by mixing a color-developing lactone compound, phenolic material, water-soluble high-molecular adhesive and, if need be, a sensitizer (sensitivity improver), wax, surface active agent, etc., in an aqueous medium, pulverizing said materials by a pulverizer such as ball mill to as much small size as possible, preferably less than 5μ, and applying the thus prepared heat sensitive coating solution on the support.

Paper is usually used for the support, but a synthetic resin film or woven fabric sheet may as well be employed. A suitable head such as air knife, rubber doctor, steel blade, roll or Meyer bar may be used for applying the heat sensitive coating solution on the support, and the coating is dried at a relatively low temperature. Since mere application of the coating solution does not provide a good surface condition, the coating is usually subjected to a surface treatment by a calendar or other means to improve the coating surface smoothness.

The invention is now described in further detail by way of some examples thereof, such examples being however not intended to be restrictive to the scope of the invention.

EXAMPLE 1

There were prepared the following three solutions A, B and C:

| | | |
|---|---|---|
| Solution A | Crystal Violet lactone | 1 weight part |
| | 5% aqueous solution of hydroxyethyl cellulose | 5 weight part |
| Solution B | 4,4'-isopropylidenediphenol | 1 weight part |
| | 5% aqueous solution of hydroxyethyl cellulose | 5 weight part |
| | Both solutions A and B were triturated separately in a ball mill for 2 days. | |
| Solution C | PERGO PAK M* (urea-formaldehyde resin mfd. by Ciba Geigy) | 1 weight part |
| | 5% sodium hexametaphosphate (dispersant) | 0.2 weight part |
| | Water | 5 weight part |

*This resin had oil absorption of 370 ml/100 g as measured according to JIS K-5101 and was sufficiently dispersed in solution C under agitation by a stirrer.

These solutions were mixed in the A:B:C ratio of 1:5:5 by weight to form a heat sensitive coating solution, and this coating solution was coated on a 45 g/m$^2$ support paper with an air knife coater such that approximately 5 g/m$^2$ of the coated weight would be provided after drying, and the coating was dried at a temperature controlled to stay below 60° C. The dried coating was further subjected to a super calender to finish into Bekk smoothness of 200 to 300 seconds, and after slitted to 180 mm width by a slitter, the paper was formed into a 100-meter roll. This roll of paper was then subjected to 100 meter printing with Toshiba Thermal Facsimile FAX KB-500 at main scanning speed of 500 lpm and recording voltage of 20 V by using of the institute of image electronic engineers of JAPAN Standard Chart No. 2, and thereafter the thermal head of the facsimile was examined. Deposition of residue on the thermal head was only 0.2 to 0.5 mm, which merely caused slight clouding of the head.

EXAMPLE 2

The following four solutions A, B, C and D:

| | | |
|---|---|---|
| Solution A | 3-piperidino-6-methyl-7-anilinofluoran | 1 weight part |
| | 5% aqueous solution of hydroxyethyl cellulose | 5 weight part |
| Solution B | 4,4'-isopropylidenediphenol | 1 weight part |
| | 5% aqueous solution of hydroxyethyl cellulose | 5 weight part |
| Solution C | Fatty Acid Amide S (stearic acid amide by Nitto Chemicals) | 1 weight part |
| | 5% aqueous solution of hydroxyethyl cellulose | 5 weight part |
| | These three solutions were triturated separately in a ball mill for 2 days. | |
| Solution D | Cab-O-Lite 100** (urea-formalin resin by Cabot Corp, particle size: 4–8μ) | 1 weight part |
| | 5% sodium hexametaphosphate (dispersant) | 0.2 weight part |
| | Water | 5 weight part |

**This resin had oil absorption of 380 ml/100 g as measured according to JIS K-5101 and was sufficiently dispersed under agitation by a stirrer.

were mixed in the A:B:C:D ratio of 1:5:3:5 by weight to prepare a heat sensitive coating solution.

There were also prepared as contrasts heat sensitive solution devoid of solution D and those using, instead of solution D, the organic or inorganic fillers commonly employed for coating, such as granular rice starch, kaolin (Ultracoat by Engelhard Corp.), clay (Zieklite by Zieklite Inc.) and talc, and each of these solutions was applied on the support paper by an air knife coater, followed by drying, super calender finish, slitting and rolling after the manner of Example 1, and each of the thus obtained rolls of paper was subjected to the test with Toshiba Thermal Facsimile FAX KB-500 in the same way as Example 1. As a result, the paper obtained by using Cab-O-Lite as solution D caused very slight tailing deposit, 0.3 to 0.8 mm, on the thermal head and mere clouding of the head was noted, whereas the papers obtained without using solution D or by using granular rice starch, clay, kaolin and talc, respectively, as solution D caused as much as 5 to 6 mm deposition of tailings on the thermal head.

EXAMPLE 3

A 40 g/m$^2$ paper support was prepared with a paper making machine by mixing and dispersing under agitation the following materials:

| | |
|---|---|
| PERGO PAK M (urea-formaldehyde resin by Ciba Geigy) | 100 weight parts |
| 15% aqueous solution of MS-3800 (starch oxide by Nippon Foods) | 100 weight parts |
| Water | 150 weight parts |

and coating this mixed solution on the paper support by a surface sizing press to provide a 4 g/m$^2$ coated weight. Then the coating solution of Example 2 blended with kaokin was applied on said paper support and the obtained paper was subjected to the same test as described above. Deposition of residue on the thermal head was very slight, 0.3 to 0.8 mm.

In the case of the paper which had no sizing press coating of PERGO PAK M and was applied with said coating solution, residue deposition of the thermal head was as heavey as 5 to 6 mm.

What is claimed is:

1. A heat sensitive paper comprising a support and a heat sensitive layer thereon containing a colorforming lactone compound and color-developing phenol compound, characterized in that a finely divided urea-formaldehyde resin having an oil absorption of 370–380 ml/100 g as measured according to the JIS K-5101 method is incorporated in at least one of the heat sensitive layer, support and between said heat sensitive layer and support.

2. A heat sensitive paper of claim 1, wherein the finely divided urea-formaldehyde resin has an average particle size of 2$\mu$ to 8$\mu$.

3. A heat sensitive paper of claim 1, wherein the finely divided urea-formaldehyde resin is incorporated in an amount of 10 to 200% based on the weight of heat fusible materials.

4. A heat sensitive paper of claim 1, wherein the heat sensitive layer contains a water-soluble high molecular adhesive.

* * * * *